US005571335A

United States Patent [19]

Lloyd

[11] Patent Number: 5,571,335

[45] Date of Patent: Nov. 5, 1996

[54] METHOD FOR REMOVAL OF SURFACE COATINGS

[75] Inventor: Daniel L. Lloyd, Mason, Ohio

[73] Assignee: Cold Jet, Inc., Loveland, Ohio

[21] Appl. No.: 315,321

[22] Filed: Sep. 29, 1994

Related U.S. Application Data

[63] Continuation of Ser. No. 175,171, Dec. 29, 1993, abandoned, which is a continuation of Ser. No. 806,029, Dec. 12, 1991, abandoned.

[51] Int. Cl.[6] ..... B08B 7/00

[52] U.S. Cl. ..... 134/1; 134/6; 134/7; 134/19; 134/38; 451/39

[58] Field of Search ..... 134/1, 6, 7, 38, 134/19; 451/39

[56] References Cited

U.S. PATENT DOCUMENTS

| | | | |
|---|---|---|---|
| 3,700,850 | 10/1972 | Lumley et al. | 219/121 LM |
| 3,986,391 | 10/1976 | Vahaviolos | 73/88 R |
| 4,075,579 | 2/1978 | Hunter, Jr., et al. | 331/95.5 G |
| 4,249,956 | 2/1981 | Hartman | 134/7 |
| 4,398,961 | 8/1983 | Mason | 134/19 |
| 4,419,562 | 12/1983 | Jon et al. | 219/130.01 |
| 4,450,568 | 5/1984 | Asmus | 372/76 |
| 4,491,484 | 1/1985 | Williams | 134/4 |
| 4,504,727 | 3/1985 | Melcher et al. | 219/121 LB |
| 4,543,486 | 9/1985 | Rose | 250/492.1 |
| 4,588,885 | 5/1986 | Lovoi et al. | 250/226 |
| 4,627,197 | 12/1986 | Klee et al. | 51/319 |
| 4,631,250 | 12/1986 | Hayashi | 430/329 |
| 4,655,847 | 4/1987 | Ichinoseki et al. | 134/7 |
| 4,682,594 | 7/1987 | Mok | 128/303.1 |
| 4,693,756 | 9/1987 | Schlick | 134/7 |
| 4,718,974 | 1/1988 | Minaee | 156/6.43 |
| 4,731,125 | 3/1988 | Carr | 134/17 |
| 4,737,628 | 4/1988 | Lovoi | 250/226 |
| 4,744,181 | 5/1988 | Moore et al. | 51/436 |
| 4,756,765 | 7/1988 | Woodraffe | 134/1 |
| 4,803,021 | 2/1989 | Werth et al. | 264/25 |
| 4,836,858 | 6/1989 | Reinhart | 134/1 |
| 4,837,794 | 7/1989 | Riordan et al. | 378/119 |
| 4,843,770 | 7/1989 | Crane | 51/439 |
| 4,867,796 | 9/1989 | Asmus et al. | 131/1 |
| 4,871,559 | 10/1989 | Dunn et al. | 426/248 |
| 4,910,942 | 3/1990 | Dunn et al. | 53/425 |
| 4,947,592 | 8/1990 | Lloyd et al. | 51/436 |
| 4,975,918 | 12/1990 | Morton | 372/20 |
| 4,994,639 | 2/1991 | Dickinson et al. | 219/121.69 |
| 5,013,366 | 5/1991 | Jackson et al. | 134/1 |
| 5,018,667 | 5/1991 | Lloyd | 239/132.5 |
| 5,024,968 | 6/1991 | Engelsberg | 437/173 |
| 5,034,235 | 7/1991 | Dunn et al. | 426/238 |
| 5,044,129 | 9/1991 | Olevitch | 51/319 |
| 5,050,805 | 9/1991 | Lloyd et al. | 239/424 |
| 5,062,898 | 11/1991 | McDermott et al. | 134/7 |
| 5,063,015 | 11/1991 | Lloyd et al. | 264/161 |
| 5,065,630 | 11/1991 | Hadcock et al. | 73/802 |
| 5,354,384 | 10/1994 | Sneed et al. | 134/6 |

*Primary Examiner*—Zeinab El-Arini
*Attorney, Agent, or Firm*—Frost & Jacobs

[57] ABSTRACT

A method for removing a surface coating by impinging an area of impingement of the surface coating with photon energy while simultaneously impinging the area of impingement with a cryogenic particle blast flow.

20 Claims, 7 Drawing Sheets

METHOD FOR REMOVAL OF SURFACE COATINGS

This is a continuation of application Ser. No. 08/175,171 filed Dec. 29, 1993, now abandoned, which is a continuation of application Ser. No. 07/806,029, filed Dec. 12, 1991, now abandoned.

TECHNICAL FIELD

The present invention relates generally to the removal of a surface coating from a substrate, and is particularly directed to the removal of surface coatings such as paint from thin or composite substrates. The invention will be specifically disclosed in connection with a method which utilizes photon energy to heat instantaneously the surface coating to a high temperature while simultaneously applying a cryogenic particle blast flow to the coating and substrate in the area being impinged by the photon energy.

BACKGROUND OF THE INVENTION

In many situations, it is desirable to remove a surface coating from the substrate to which it is adhered, for reasons such as repair, repainting or inspection of the substrate. There are many instances in which such removal becomes problematic, such as when the substrate is particularly susceptible to damage as with thin substrates and substrates made of composite materials.

In particular, in the aircraft industry, removal of surface coatings is significantly difficult. The surfaces of aircraft are typically very thin, on the order of 0.020 inches thick, and may be made of composite materials so as to reduce the weight while maintaining high strength structures. Although composite materials are not susceptible to corrosion or fatigue cracking, metal air frames must be treated for corrosion and inspected periodically to prevent catastrophic failure due to metal fatigue. Surface coatings must be completely removed in order to conduct a thorough inspection. During maintenance operations, all aircraft surfaces and components must typically be thoroughly cleaned. The process used to remove a surface coating from an aircraft surface or component must not cause damage thereto. At the same time, the process must be capable of completely removing the surface coating.

Presently, chemicals are typically used to remove surface coatings from aircraft. These chemical compounds frequently are ineffective and inefficient, requiring several applications and manual scrubbing of the surfaces. These chemicals are generally highly toxic, and dangerous to use. Although protective clothing is available, it is frequently not used because it is uncomfortable, hot and interferes with the efficiency of the cleaning process.

The use of chemicals to clean aircraft present problems to the environment of the worker as well as to the earth's environment. The chemicals are preferably used in an enclosed area so that the fumes and airborne constituents of the chemicals and surface coating may be filtered and prevented from release to the atmosphere. However, because of the size of aircraft, no matter what precautions are taken, some chemicals may leak into the atmosphere. There is a disposal problem with the chemicals as well, which must be treated as hazardous waste.

Media blasting has also been used in an attempt to remove such surface coatings. One such example is plastic media blasting (PMB), which has met with only limited success. The removal of the surface coating utilizing only the kinetic energy of the plastic media and thereby abrading the coating requires that the particles impart sufficient energy to the coating. At the energy levels necessary to remove the coating, some damage to the substrate is typically inevitable. The plastic media also tends to become lodged in structural joints and other areas. Although the plastic media is reusable, the efficiency of the PMB process drops by about 75% when the media is reused, even in combination with new media. Even though PMB does not produce hazardous waste as chemicals do, the used plastic media is contaminated with the removed surface coating and large quantities of media must be disposed of.

Cryogenic particle blasting, and as more specifically described herein, $CO_2$ particle blasting, has also been used to remove surface coatings from aircraft surfaces and components. Because the $CO_2$ pellets sublimate into a gas which is naturally found in the atmosphere, cleanup and environmental concerns are minimized. Even though $CO_2$ pellets may become lodged in structural joints, the characteristic of sublimation causes this to be inconsequential. However, $CO_2$ particle blasting may be too slow for the removal of some coatings, and may be too aggressive to be used on certain substrates.

Equipment and methods relating to $CO_2$ particle blasting are disclosed in U.S. Pat. Nos. 4,744,181, 4,843,770, 4,947,592, 5,018,667, 5,050,805 and 5,063,015, all of which are incorporated herein by reference. As used herein, it will be understood that $CO_2$ particle blasting refers not only to the blasting process which utilizes carbon dioxide pellets or particles, but any cryogenic particle blasting process which utilizes sublimable pellets or particles.

Another way to remove surface coatings is to ablate the surface coating by heating the surface coating above its chemical flash point temperature so that it is ablated. The surface coatings can be heated very quickly to such temperatures by impinging the surface coating with photon energy. Sources of photon energy include lasers, such as $CO_2$ lasers, ruby lasers and xenon lasers. Once the surface coating is completely ablated, the residue must be removed. Chemical compounds as well as $CO_2$ particle blasting have been used to remove this residue after the ablation process is complete.

Ablation of surface coatings presents problems with heat damage to the substrate. If the incident photon energy is applied for too long a period of time, significant heat will transfer to the substrate, raising its temperature and damaging it. If there is also a surface coating on the backside of the substrate, which is frequently is inaccessible, that surface coating may peel due to the increased temperature of the substrate, and expose the backside of the substrate to corrosive conditions.

Therefore, the use of lasers to ablate a surface coating requires substantial control of the process. For example, with a monofrequency laser such as a $CO_2$ laser, a continuously moving beam is swept across the area of impingement of the surface coating. The sweep rate of the beam is one way to control how much energy is imparted to a specific location within the area of impingement. Thus, any particular location is impinged by the relatively narrow beam several times for a short duration, as the area of impingement advances across the surface coating. The laser beam itself may be a continuous beam or it may be pulsed. In either case, specific locations on the surface coating are directly impinged by the beam several times for a short duration.

Although it is possible to provide adequate beam control in a laboratory setting so as to ablate a surface coating to a controlled depth, when applied to the removal of a surface coating on an aircraft there are substantial problems. Because the laser is powerful enough to damage the metal substrate, if the operator allows the area of impingement to dwell at one place for too long, if the standoff distance varies too much, or if the thickness of the surface coating varies, such as from 0.008 inches to 0.004 inches, the laser can completely ablate the surface coating and impinge directly on the substrate, thereby damaging it. Sufficient beam control has not yet been achieved to allow the use of lasers to ablate surface coatings on aircraft surfaces and components.

Another type of laser utilizing xenon has also been used to ablate surface coatings on aircraft. Xenon lasers, referred to generically herein as "flashlamps" are known in the art and have been described, for example, in U.S. Pat. Nos. 4,075,579, 4,450,568, 4,837,794, 4,867,796, 4,871,559, 4,910,942, 4,975,918 and 5,034,235, all of which are incorporated herein by reference. The flashlamp consists of a quartz tube filled with xenon gas which emits a brilliant flash of light when electrically energized. This light is multifrequency. The impingement of this photon energy on surface coatings results in the ablation of the coating. However, its usefulness with respect to aircraft surfaces and components is limited because of the heat transfer to the substrate. Additionally, when the outer surface of the coating is ablated, it becomes charred, and if left in place impedes the penetration of subsequent photon energy flashes from the flashlamp, preventing the ablation of the entire thickness of the coating.

Thus, there remains a need for an efficient and cost effective process which is capable of completely removing a surface coating from a substrate, such as aircraft surfaces and components, without damaging the substrate. The process must avoid the use of hazardous materials and disposal requirements of any materials used.

SUMMARY OF THE INVENTION

Accordingly, it is a primary object of the present invention to obviate the above described problems and shortcomings of methods for removing surface coatings heretofore available in the industry.

It is another object of the present invention to provide a method by which a surface coating can be completely removed from a substrate without damaging the substrate.

It is yet another object of the present invention to provide a method for removing a surface coating from a substrate which is capable of operating on curved and irregular surfaces.

Yet another object of the present invention is to provide a method for removing surface coatings which will not intrude into joints and other spaces.

A still further object of the present invention is to provide a method for removing surface coatings which does not create a hazardous environment for the operator nor use hazardous materials.

Another object of the present invention is to provide method for removing a surface coating which minimizes disposal requirements.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided a method for removing a surface coating by impinging an area of impingement of the surface coating with photon energy while simultaneously impinging the area of impingement with a cryogenic particle blast flow. The intensity of the photon energy is sufficient to heat the surface coating so quickly that a high temperature at the surface of the surface coating is achieved. In one aspect, the surface coating is ablated. In another aspect, the temperature of portions of the surface coating is raised to a temperature which is below the chemical flash point temperature of the surface coating but high enough to cause pyrolysis of the coating, thereby resulting in degradation of the surface coating-substrate bond. In yet another aspect, portions of the surface coating are ablated while other portions are pyrolized. The simultaneous application of cryogenic particle blast flow, and in particular $CO_2$ particle blast, provides immediate (both in time and physical location) cooling directly to the substrate, thereby limiting the temperature increase of the substrate to safe levels. The simultaneous application of $CO_2$ particle blast flow also immediately removes ablated portions of the surface coating which are impacted, removes pyrolized portions of the surface coating while the bonds of those pyrolized portions are in their weakest state, abrades, to a lesser degree, other portions of the surface coating adjacent the area of impingement which are ablated or pyrolized, and cools the surface of the thusly exposed surface of the coating.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its seeral details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1:
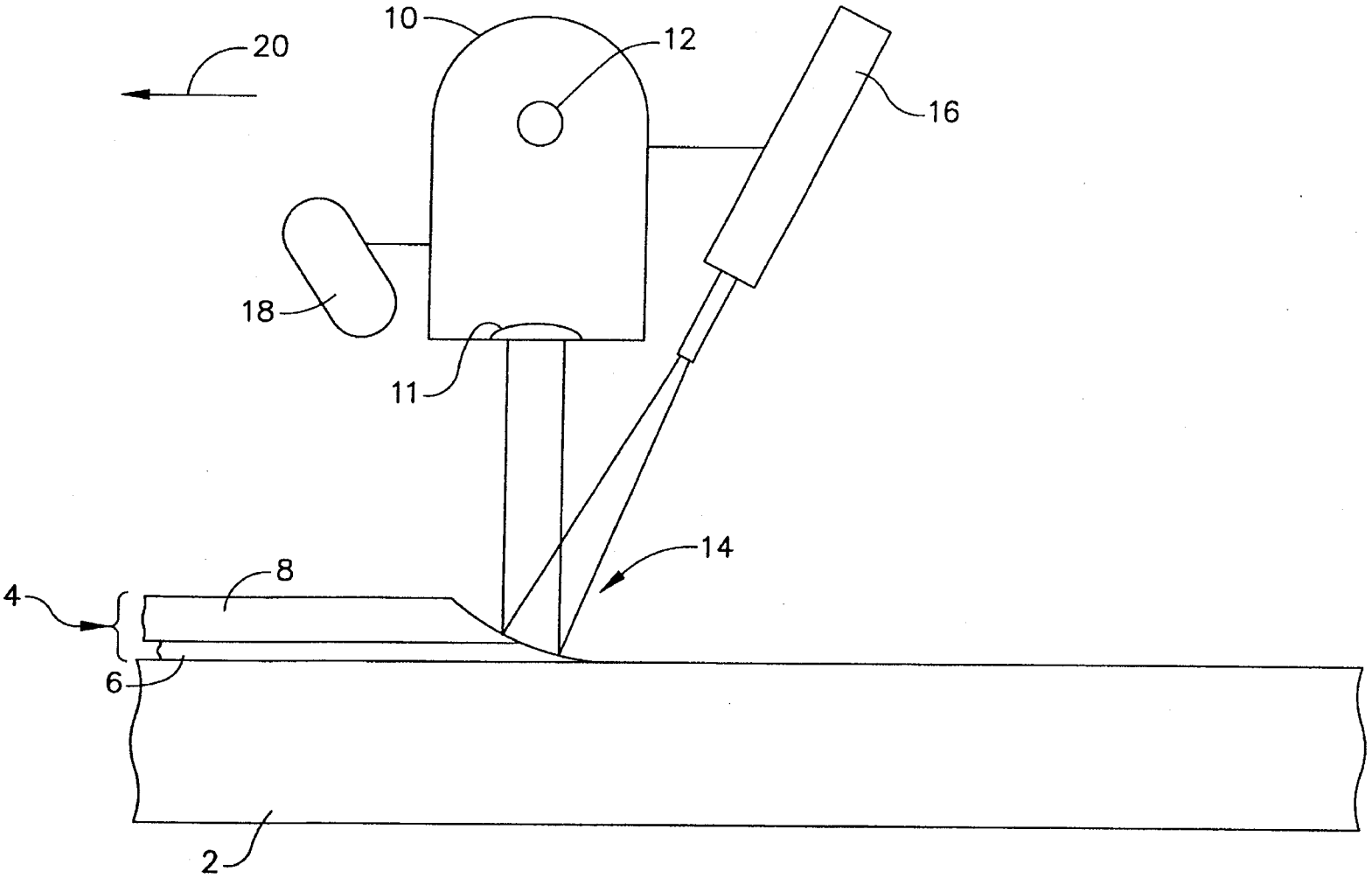
FIG. 1 is a diagrammatic illustration of a flashlamp head in combination with a $CO_2$ particle blast nozzle practicing the method of the present invention on a metallic substrate.

Reference will now be made in detail to the present preferred embodiment of the invention, an example of which is illustrated in the accompanying drawings.

DETAILED DESCRIPTION OF THE PREFERRED EMBODIMENT

The general method of the present invention for removing a surface coating from a substrate comprises the step of impinging an area of impingement of a surface coating with photon energy while simultaneously impinging the area of impingement with a cryogenic particle blast flow. This simultaneous application of photon energy and cryogenic particle blast flow allows energy to be imparted primarily to the surface coating and not to the substrate, thereby resulting in a significant and substantial increase in the temperature of the surface coating without a deleterious increase in the temperature of the substrate.

According to my method, photon energy is transferred to the area of impingement sufficiently quick so as to produce an immediate and essentially instantaneous temperature rise starting at the surface of the surface coating. The amount of this temperature rise is determined by the intensity of the incident photon energy in conjunction with the thermal conductivity of the surface coating, the substrate and the removal of energy by the cryogenic particle blast flow. The photon energy, when delivered to the surface coating as an intense photon discharge creates a temperature gradient through the surface coating and substrate which is dependent upon and varies with time as the energy is transferred from the surface to the coating and substrate by conduction.

In the practice of this method, the intensity of the incident photon discharge may be sufficient to ablate the surface coating. When closely controlled, such as in a laboratory setting, the depth of penetration can be limited. However, the practical application of this method limits the degree of ablation based on the temperature rise of the substrate. For example, aircraft substrates such as thin aluminum or composite materials must be kept below 200° F. in order to maintain structural integrity, as well as to prevent peeling of any surface coating on the backside of the substrate. When photon energy is used alone as described above with the prior art, the depth of ablation cannot be sufficiently controlled to prevent damage to the substrate, through direct impingement of the energy on the substrate or thorougly overheating thereof.

In the present invention, the amount of energy transferred by the photon discharge is limited to an amount which cannot damage the substrate by direct impingement and which, in conjunction with the cooling effect of the cryogenic particle blast flow as described below, does not increase the temperature of the substrate high enough to cause damage to the substrate or peel any coatings on the backside of the substrate. In the case of a metallic substrate, once the surface coating has been completely removed, the amount of energy transferred to the bare substrate is actually less than the amount of energy transferred to the substrate while still coated by a surface coating. This is because of a significant difference in the reflectivity of the bare metallic substrate in comparison to the coated metallic substrate. That is, more of the incident photon energy is reflected by the exposed substrate than by the surface coating.

Ablation of the surface coating is not required for the successful practice of the method of this invention. In one aspect of this method, the surface coating is not ablated, but only pyrolized by raising the temperature to a temperature below the chemical flash point temperature of the surface coating. This weakens the bonds of the surface coating, which when impinged by the cryogenic particle blast flow are sufficiently weak so as to allow removal of the portion of the surface coating which has been pyrolized.

As discussed, the energy of the photon discharge incident on the surface coating and substrate may range from ablating the entire coating layer (subject to the constraints on the temperature rise of the substrate itself) to pyrolizing the coating without any ablation. In between these two ends of the spectrum, the energy transferred by the photon discharge may produce ablation of the outer layer of the surface coating, and pyrolize subjacent layers of the coating.

Any photon energy source capable of delivering the necessary discharge of photon energy may be used. Such sources would the include the $CO_2$ laser and xenon flashlamp described above. Since the main goal of the transfer of energy is to elevate the temperature of the surface coating while minimizing the increase in the temperature of the substrate, it is necessary that the photon energy be very intense and capable of creating an instantaneous temperature rise in the surface. If the photon energy discharge continuously impinged the surface coating, the temperature gradient (difference) across the surface coating and into the substrate would result in an extremely high steady state substrate temperature. Such continuous impingement of photon energy would necessitate either the deliver of a lower level of photon energy (which would reduce the temperature increase of the coating) or the provision of significant cooling to prevent overheating of the substrate.

The delivery of high photon energy in short pulses allows intense and immediate heat to be transferred to the outer layers of the surface coating without immediate transfer to the substrate. Although the surface temperatures are high the penetration of heat into the surface is minimal due to the short pulse duration and thermal properties of the paint surface, as well as the cooling effect of the cryogenic particle blast flow. The delivery of intense photon energy for a short period of time in combination with continuous cooling by the cryogenic particle blast flow prevents a deleterious temperature rise in the substrate.

As mentioned above, a cryogenic particle blast flow impinges the area of impingement of the surface coating simultaneously, or at least substantially simultaneously, with the impingement of the pulsed photon energy. This flow serves several purposes. It provides substantial cooling to the substrate which prevents overheating of the substrate. As the cryogenic particles strike an ablated surface coating or portion thereof, the residue is removed. Any portions of the surface coating in the area of impingement, and as well as adjacent areas, whose bonds have been degraded by pyrolysis are also removed by the cryogenic particle blast flow. The mass flow rate, pressure, particle size and particle density are selected to provide sufficient cooling and to transfer kinetic energy which is sufficient to remove the ablated or pyrolized coating.

The simultaneous combination of the (pulsed) photon energy with the cryogenic particle blast flow allows improved performance over the separate use thereof. When the photon energy is used to completely ablate the surface coating, the continuous cryogenic particle blast flow balances the temperature, thereby eliminating the possibility of excessive substrate temperatures. In this mode, the mass flow rate and pressure of the cryogenic particle blast flow is less than when used alone since the cryogenic particle blast flow is removing the residue rather than the coating surface.

In the mode where the surface coating is pyrolized, less photon energy is used while the amount of kinetic energy which must be delivered by the cryogenic particle blast flow is higher than with the ablation mode (but still lower than when used alone). In the pyrolysis mode, the required cooling effect from the cryogenic particle blast flow is less than in the ablation mode. In the mode of operation wherein part of the surface coating is ablated and part of the surface coating pyrolized, the operational requirements of the respective photon energy source and cryogenic particle blast flow are in between.

Although the method of the present invention is capable of being carried out by many different photon energy sources in combination with different cryogenic particle blast flows, the method will be described in which a flashlamp is combined with a $CO_2$ particle blast flow. Although the method is equally applicable to numerous substrates, the discussion which follows is particularly directed to substrates utilized in the aircraft industry, such as thin metal or composite materials.

Referring now to FIG. 1, there is shown a specific embodiment of the practice of the general method of the present invention. Metal substrate 2 is shown having surface coating 4 consisting of primer layer 6 and top coat 8. Surface coating 4 has been partially removed from substrate 2 by a process in accordance with the present invention.

Flash lamp head 10 is shown overlying substrate 2, spaced apart therefrom by a standoff distance between one-half to two inches. (The distance has been exagerated in FIGS. 1 and 7 for clarity.) Flashlamp head 10 includes lamp 12 which is filled with xenon gas and which is energized to emit short bursts of photon energy. Flashlamp head 10 includes lens 11 which is configured to focus this photon energy at area of impingement, generally indicated by 14, of substrate 2 and surface coating 4. Lens 11 is preferably made of high lead crystal or quartz to provide longer life for the lens.

$CO_2$ particle blast nozzle 16 is shown connected to flashlamp head 10, overlying substrate 2 and oriented so as to direct a continuous flow of $CO_2$ pellets so as to impinge area of impingement 14 continuously.

Figure 2:
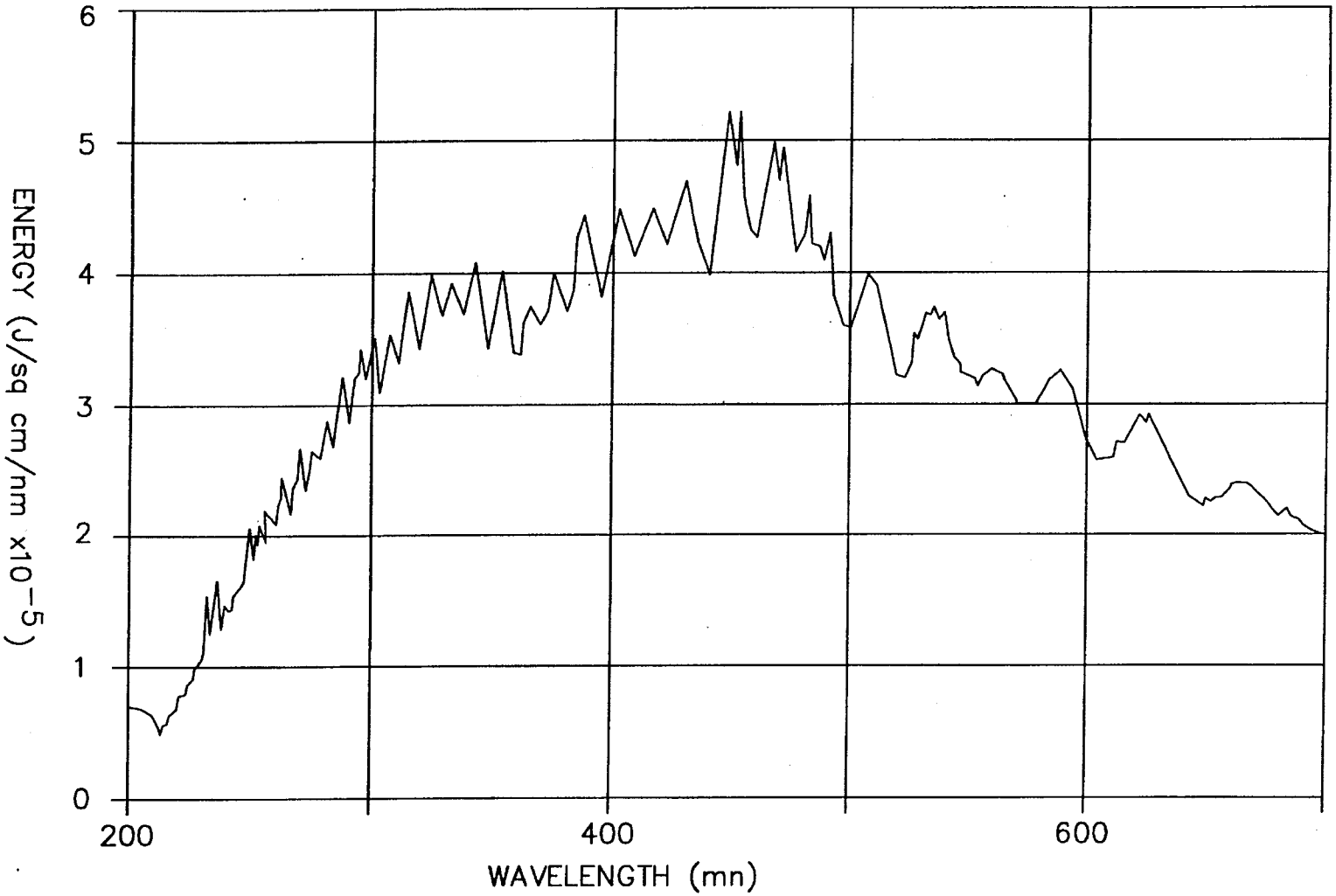
FIG. 2 is a graph of energy versus wave length for the flashlamp.
Figure 3:
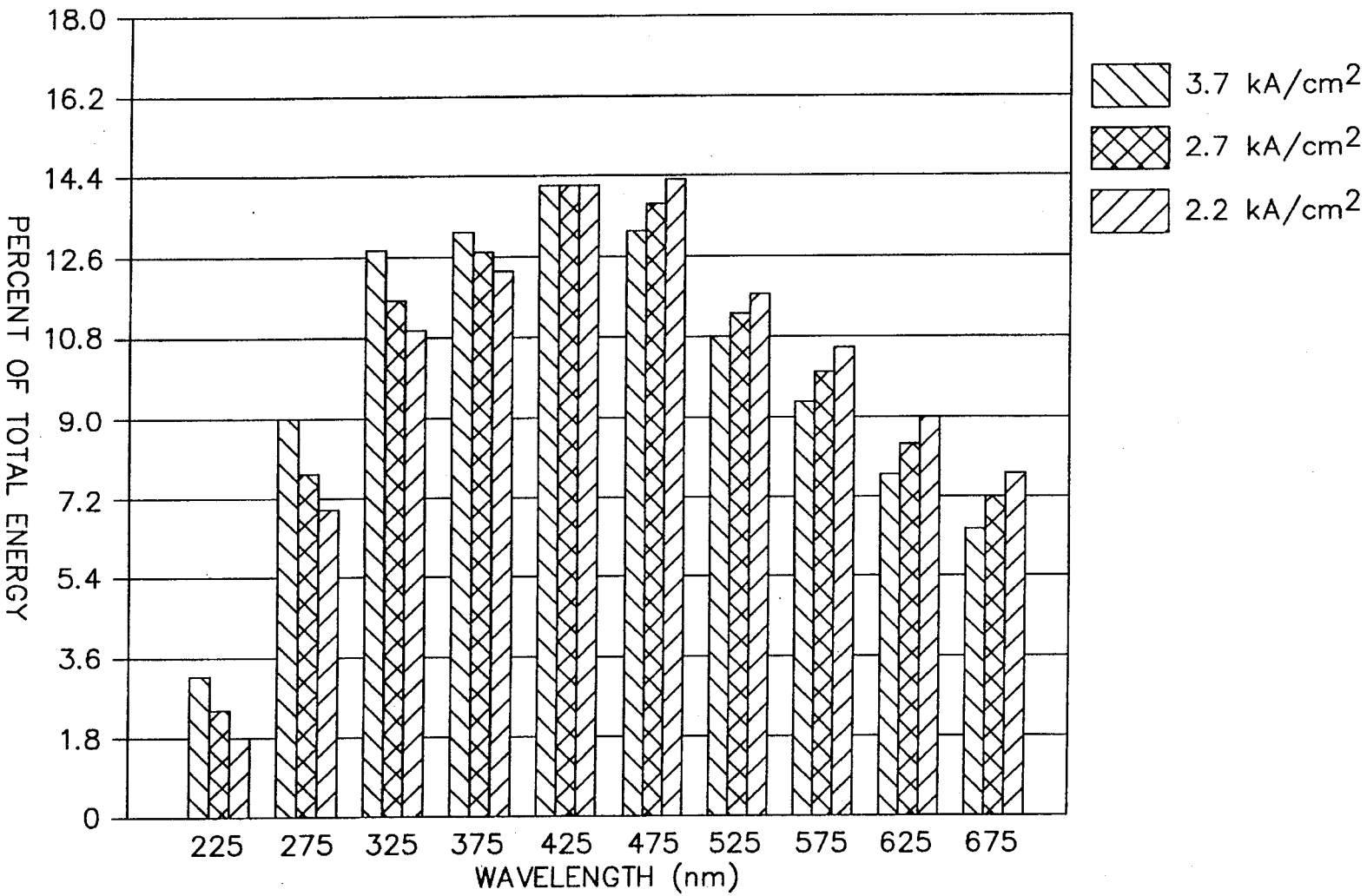
FIG. 3 is a graph of the percent of total energy to wave lengths of the flashlamp.
Figure 4:
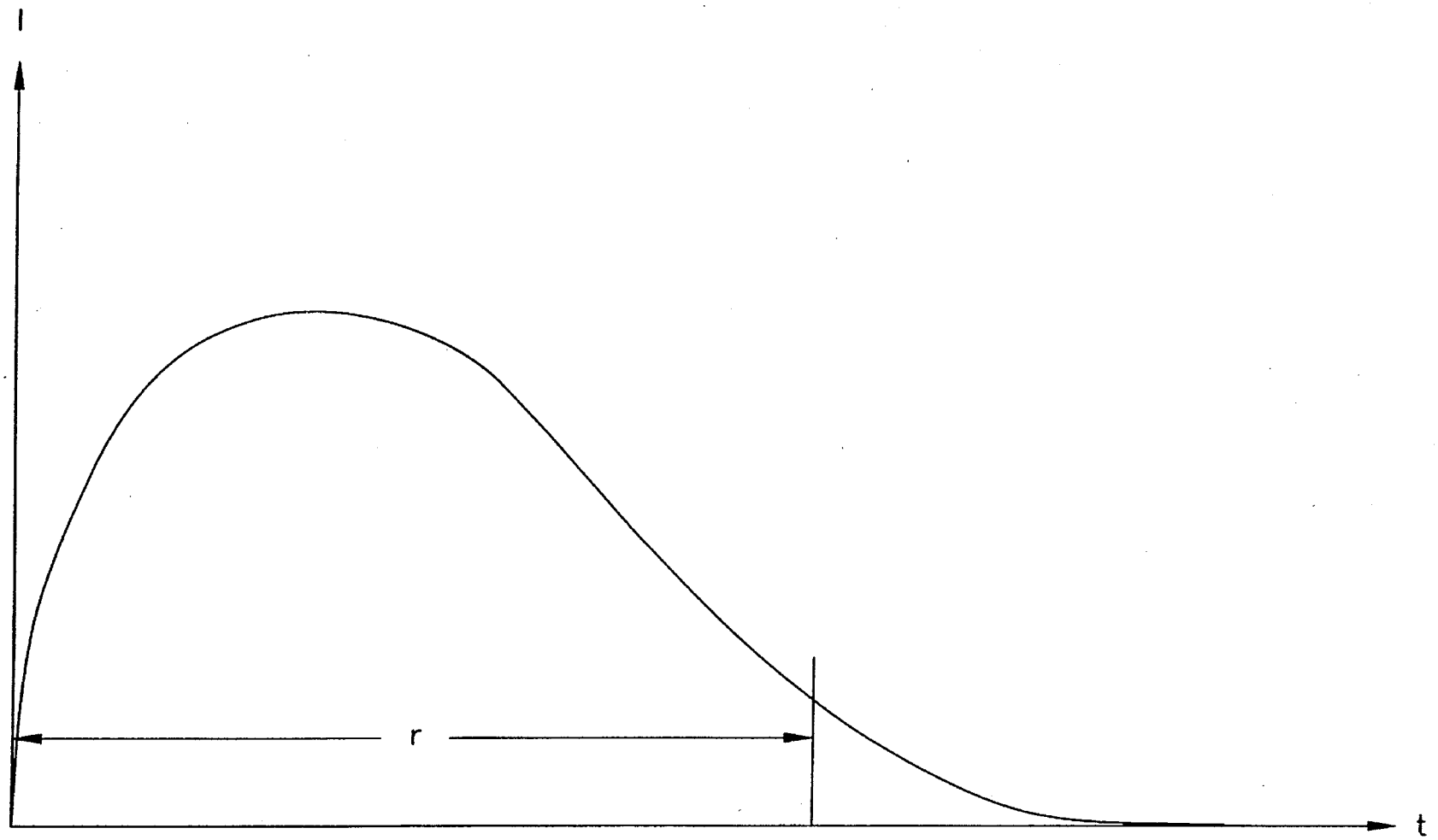
FIG. 4 is a graph of the pulse shape of the photon pulse discharge of the flashlamp.

Overlying substrate 2 and surface coating 4, and shown connected to flashlamp head 10 on the opposite side from nozzle 16 is pressure sensor 18. Sensor 18 is aimed at area of impingement 14 and is utilized to determine when surface coating 4 has been removed from area of impingement 14 so that the control system (not shown) can advance continuously moving flashlamp head 10, nozzle 16 and sensor 18 and concomitantly area of impingement 14 in the direction of arrow 20 in the continuous process of removal of surface coating 4. Lamp 12 is operated so as to produce an intense discharge of broad band multifrequency photon energy having a duration of between approximately 0.5 to 2 milliseconds, with good results being achieved with 1 millisecond. A typical frequency distribution of this discharge is shown in the graph of FIG. 2. The graph of FIG. 3 illustrates the percent of total energy versus the wave length. FIG. 4 illustrates the intensity of a typical photon energy pulse for the duration of the discharge. The pulse repetition rate of the photon discharge is between 0.1 and 5 Hz, and has been observed to be particularly efficient at 5 Hz.

Figure 5:
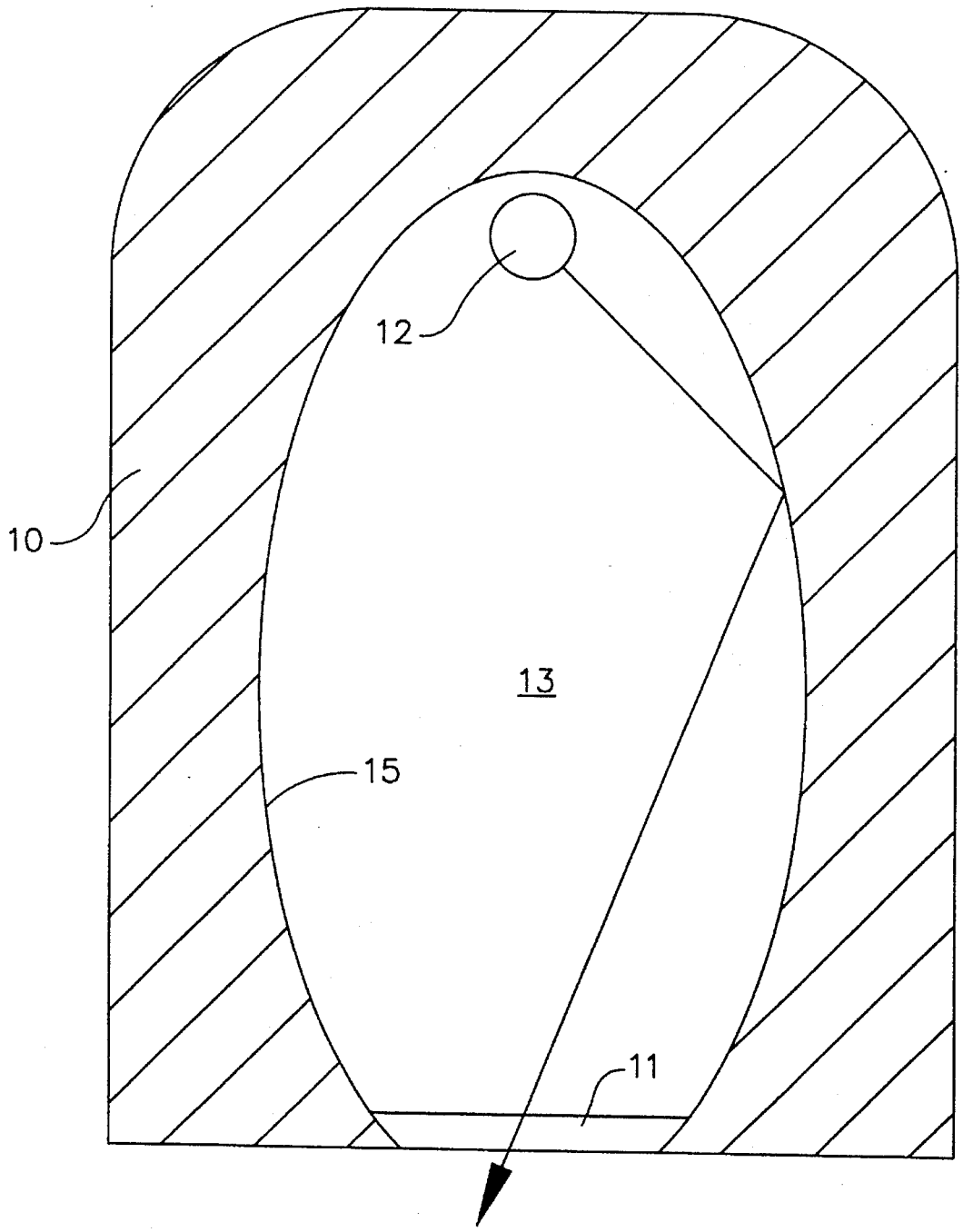
FIG. 5 is a diagrammatic cross-sectional view of the flashlamp head of FIGS. 1 and 7.

FIG. 5 illustrates a diagramatic cross-sectional view of flashlamp head 10. Interior cavity 13 of flashlamp head 10 in which lamp 12 is disposed includes eliptical reflector 15 which is designed to direct the photon energy out of cavity 13 through lens 11. Lens 11 is approximately 6 inches deep (into the drawing) and 0.5 inches wide, and focuses the photon energy into area of impingement 14 having approximately the same dimensions. The depth of nozzle 16 (into the page of FIG. 1 and 7) is slightly wider than the depth of area of impingement 14, extending by approximately one-half inch on either side of the depth for a total of 7 inches. This allows the $CO_2$ particles to impinge a broader area than area of impingement 14. It is noted that the $CO_2$ particle blast flow also functions to keep lens 11 clear, which otherwise tends to become covered with soot which reduces the efficiency.

When operated in the ablation mode on a polyurethane surface coating, a thin layer of top coat 8 may be heated above its boiling point (typically greater than 300° to 400° C.) evaporating the paint and leaving a fine soot. In order to achieve ablation, an energy density of at least 15 $J/cm^2$ at the surface coating is needed, and the process works particularly well if the energy density is 20 $J/cm^2$. This fine soot layer is removed by the continuous impingement of $CO_2$ pellets on area of impingement 14. By the time of the next photon discharge, approximately 200 milliseconds later, this layer of soot has been removed exposing any subadjacent layer not removed by the $CO_2$ pellet blast to the subsequent photon discharge. This layer by layer removal continues until bare metal is exposed. As shown, the thickness of surface coating 4 across the width of area of impingement 14 is not necessarily uniform during this process, with the trailing edge being thinner than the leading edge.

Although the surface temperatures are high, the penetration of heat into the surface and into the substrate is minimal due to the short pulse length of the flashlamp, the thermal properties of the coating surface and the cooling effect of the $CO_2$ pellet flow. The $CO_2$ pellet flow has a minimal effect on the ablation process itself, working primarily to remove soot layers and non-ablated coating layers, and to cool substrate 2. In the embodiment shown in FIG. 1, a mass flow rate of approximately 100 lbs. per hour of carbon dioxide, at a pressure as low 100 psi was sufficient to provide adequate cooling and coating removal. The $CO_2$ pellets had initial diameters between 0.100 to 0.250 inches and lengths of up to 0.250 inches. At the exit of the nozzle, these pellets ranged in size between 0.100 to 0.250 inches in length. For this process, pellets of a medium density ranging between 85–92 $lbs/ft^3$ were used, and more particularly pellets with a density of about 88 $lbs/ft^3$.

It is noted that these parameters vary with the application, the surface coating and the angle of incidence. The angle of incidence of the $CO_2$ particle flow is measured between the substrate and the direction of the flow. When operated in the ablation mode, flashlamp head 10 is located very close (0.5 inches) to coating 4, requiring a low angle in order to get the $CO_2$ flow into area of impingement 14. At low angles, less kinetic energy is transferred to the surface coating. In the pyrolysis mode, flashlamp head 10 is farther away from coating 4, allowing a higher angle for the $CO_2$ flow. It is noted that the mass flow rate, in conjunction with the angle of incidence must be sufficient to provide the necessary cooling to prevent the substrate from overheating. Increasing the mass flow rate of $CO_2$ pellets results in a direct increase in the maximum strip rate which can be obtained. However, there is a balance between damage to the metal substrate and the mass flow rate/incident angle. It is noted that an angle of incidence of 75° appears to be a good optimized angle. Higher angles impart more kinetic energy to the surface and may be too aggressive. Lower angles may require an increase in the mass flow rate in order to maintain equal energy transfer to the surface.

Figure 6:
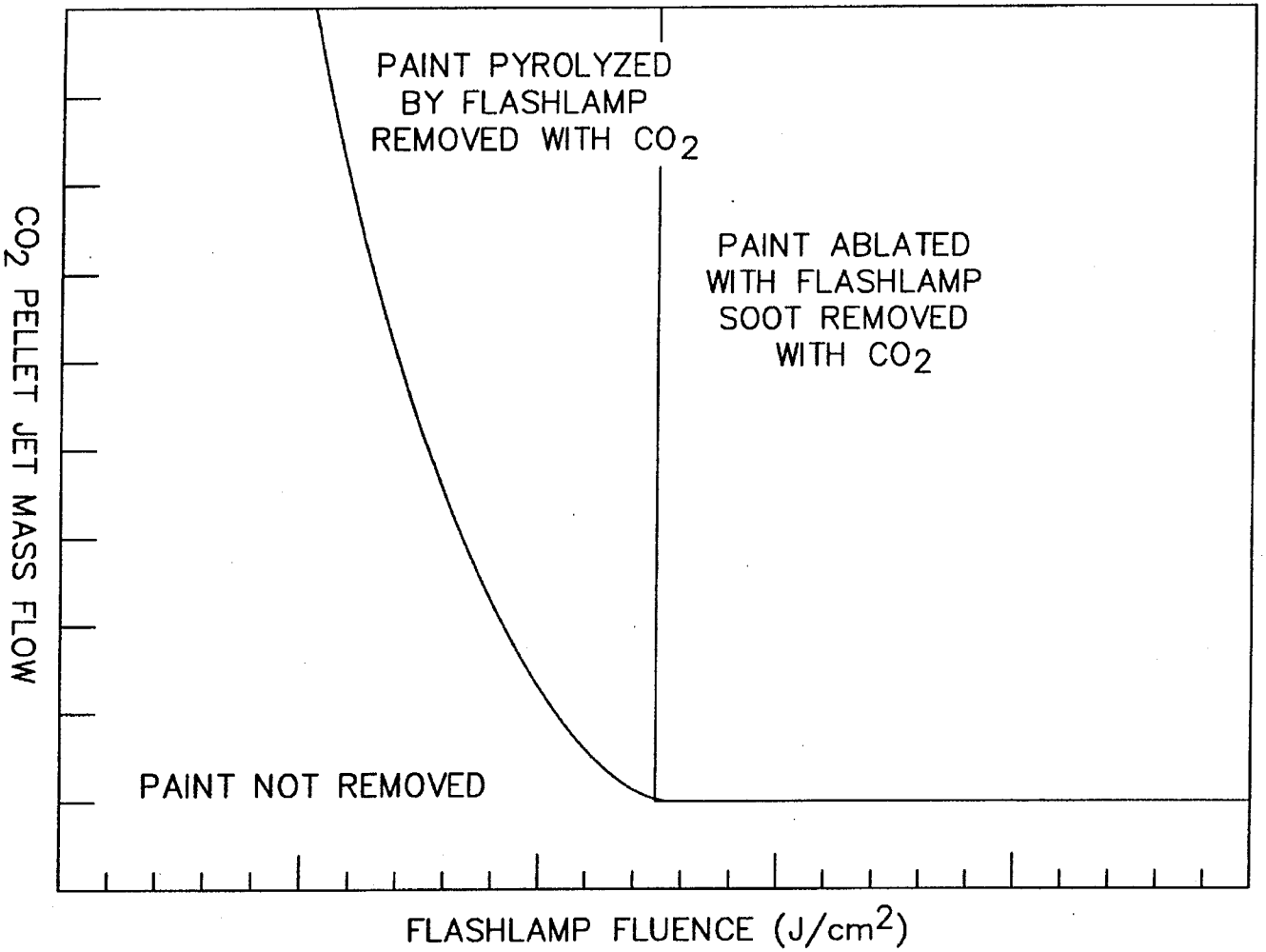
FIG. 6 is a general graph of $CO_2$ pellet mass flow versus flashlamp fluence or energy density.

At lower levels of photon energy discharged by flashlamp head 10, or at large standoff distances, the temperature rise of substrate 4 will be insufficient to cause ablation, but sufficient to cause pyrolysis of the surface coating, thereby resulting in degradation of the coating-substrate bond. In this mode, less cooling effect is required of the $CO_2$ flow, but more kinetic energy is necessary to effect the removal of the weakened surface coating 4. The graph of FIG. 6 generally illustrates the incident energy density versus $CO_2$ pellet mass flow required for the illustrated embodiment of the method according to the present invention. It is noted that as the energy density decreases into the pyrolysis mode below 15 J/cm$^2$, the $CO_2$ pellet mass flow rate required for coating removal increases. It is also noted that in the ablation mode above 15 J/cm$^2$, the required $CO_2$ pellet mass flow rate remains relatively constant.

As previously mentioned, FIG. 1 illustrates pressure sensor 18 which is utilized in controlling the generally continuous advancement of flashlamp head 10 in the direction of arrow 20. When the photon energy discharged by lamp 12 is absorbed by surface coating 4 an acoustical shock wave is produced by hot vapor generated at the surface. The strength of the shock wave is proportional to the energy absorbed by coating 4. A coating surface is highly absorbent, producing a strong shock wave, while a typical aircraft metal surface is reflective, producing a weak shock wave. Pressure sensor 18 has a quick response time and is used to monitor the shock strength. When the shock strength drops below a predetermined level which indicates that all or a predetermined portion of metal substrate 6 is exposed at area of impingement 14, a control system (not shown) advances the robotic end effector (not shown), by which flashlamp head 10, nozzle 16 and sensor 18 are carried, in the direction of arrow 20. The control system can be programed to direct the robotic end effector to follow a path which covers the entire aircraft or portions thereof.

Figure 7:
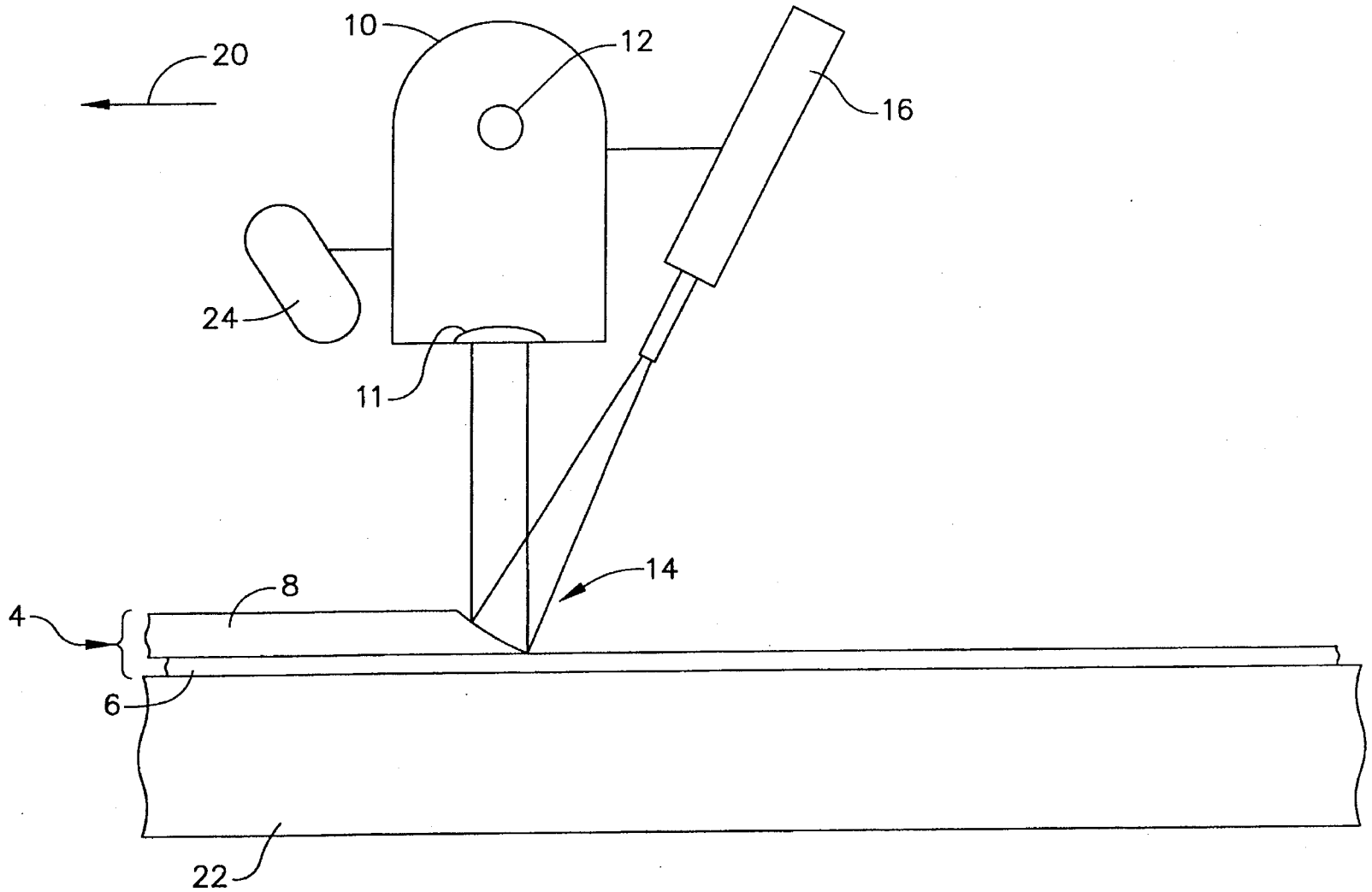
FIG. 7 is a diagrammatic illustration of a flashlamp in combination with a $CO_2$ particle blast nozzle practicing the method of the present invention on a composite substrate.

The application of the method of the present invention to the removal of surface coatings from substrates made of composite materials is subject to different limitations arising from the presence of the composite substrate. Referring to FIG. 7, a specific embodiment of the general method of the present invention utilizing flashlamp head 10 and $CO_2$ blast nozzle 16 is illustrated. Substrate 22 is made of a composite material, such as epoxy graphite. Composite substrate 22 can be damaged if directly impinged by the photon energy from flashlamp head 10. It is therefore necessary to prevent the high energy photon discharge from directly impinging on the surface of composite substrate 22. To accomplish this, only top coat 8 of surface coating 4 is removed, leaving primer coat 6 which protects substrate 22. When top coat 8 is thusly removed, the exposed primer coat 6 is clean and ready for non-destructive inspection and non-destructive testing procedures or for repainting.

In order to control the process sufficiently so as to leave primer coat 6, it is necessary for flashlamp head 10 and nozzle 16 to be advanced at a rate sufficient to preclude the removal of primer layer 6. Because primer coat 6 exhibits similar, if not identical, acoustical characteristics as top coat 8 when absorbing the photon energy generated by lamp 12, pressure sensor 18 cannot be used. Instead, fiber optic sensor 24 is provided which monitors the light emitted by the after glow of the hot ablated top coat 8. Sensor 24 is aimed at area of impingement 14. Primer coat 6 typically includes a corrosion inhibitor which contains chromium (as chromate or dichromate) which can be detected by a strong emission line at 424 nanometers. When top coat 8 has been removed, the 424 nm line will appear. The control system (not shown) which receives the signal from optical sensor 24 controls the speed of the continuously moving robotic end effector (not shown) so as to preclude the removal of primer layer 6. This control technique does not depend on the thickness, color or homogeneity of top coat 8.

In summary, numerous benefits have been described which result from employing the concepts of the method of the present invention. The method allows efficient removal of surface coatings from substrates without damaging the substrates. The method does not utilize hazardous materials nor require disposal of the removal media.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A method of removing a surface coating from a substrate, comprising:

a) applying energy to an area of impingement of the surface coating so as to elevate a temperature of at least a portion of the surface coating within the area of impingement to a temperature at least as high as that required to pyrolyze the surface coating; and b) while said at least a portion of the surface coating is at a temperature above that required to pyrolyze the surface coating, impinging the area of impingement with cryogenic particles.

2. A method as recited in claim 1 wherein the temperature of said at least a portion of the surface coating within the area of impingement is elevated to a temperature substantially above the temperature of adjacent portions of the surface coating, and the area of impingement is impinged with cryogenic particles while the temperature of said at least a portion of the surface coating of the area of impingement is at a temperature at least as high as that required to pyrolyze the surface coating.

3. A method as recited in claim 1 wherein the energy applied to the area of impingement is applied intermittently as a series of pulses, and the area of impingement of the surface coating is cooled by the impingement of the cryogenic particles during the series of pulses so as to limit energy conducted through the surface coating to the substrate.

4. A method as recited in claim 1 wherein the energy applied to the area of impingement and the cryogenic particles come from respective sources and said sources are relatively movable with respect to the surface coating, and said sources are systematically moved with respect to the surface coating thereby moving the area of impingement.

5. A method as recited in claim 4 wherein the sources of both the energy applied to the area of impingement and the cryogenic particles are moved relative to the surface coating in accordance with conditions of the surface coating within the area of impingement.

6. A method as recited in claim 1 wherein the surface coating has a chemical flash point temperature and wherein the temperature of said at least a portion of the surface coating within the area of impingement is below the chemical flash point temperature, and impact of the cryogenic particles removes at least a portion of the pyrolyzed surface coating in the area of impingement.

7. A method as recited in claim 1 wherein the temperature of said at least a portion of the surface coating within the area of impingement is elevated to a temperature sufficiently high to cause at least partial ablation of at least a portion of the surface coating within the area of impingement.

8. A method as recited in claim 1 wherein the energy is applied to the area of impingement as a series of pulses of photon energy.

9. A method as recited in claim 8 wherein the cryogenic particles are substantially continuously impinged against the surface coating within the area of impingement as the series of pulses of photon energy is applied to the area of impingement.

10. The method as recited in claim 8 wherein the photon energy is emitted from a flashlamp and the cryogenic particles are $CO_2$ particles.

11. A method as recited in claim 8 wherein the photon energy is emitted from a source, and further comprising sensing conditions of the surface coating in the area of impingement with a sensor, and moving the source of photon energy relative to the surface coating in response to conditions sensed by the sensor.

12. A method as recited in claim 11 wherein the sensor measures acoustical shock waves produced by vapor of the surface coating in the area of impingement that is generated by application of the photon energy to the surface coating within the area of impingement.

13. A method as recited in claim 11 wherein the photon energy is produced by a flashlamp and the sensor measures light reflected from the surface coating, and the flashlamp is moved relative to the surface coating in response to light reflections.

14. A method as recited in claim 1 wherein pulses of multifrequency photon energy having a duration of between approximately 0.5 to 2 milliseconds are applied to the area of impingement.

15. A method as recited in claim 1 wherein pulses of photon energy having a frequency between 0.1 and 5 Hz are applied to the area of impingement.

16. A method as recited in claim 1 wherein the surface coating is polyurethane and photon energy of approximately 20 $J/cm^2$ is applied to the surface coating within the area of impingement.

17. A method as recited in claim 1 wherein sufficient energy is applied to the surface coating to ablate at least a portion of the surface coating within the area of impingement.

18. A method as recited in claim 1, wherein the impingement of the surface coating with cryogenic particles in the area of impingement occurs substantially simultaneously with the application of energy so as to maintain the substrate at a temperature at which the substrate is not damaged by heat.

19. A method as recited in claim 1, wherein an area of the surface coating adjacent the area of impingement is impinged by cryogenic particles.

20. A method as recited in claim 1, wherein energy is applied to an area of the surface coating adjacent the area of impingement.

* * * * *